US011059306B2

(12) United States Patent
Perera et al.

(10) Patent No.: US 11,059,306 B2
(45) Date of Patent: Jul. 13, 2021

(54) DEVICE FOR DIRECT TO GARMENT PRINTING

(71) Applicant: MAS INNOVATION (PRIVATE) LIMITED, Colombo (LK)

(72) Inventors: Prins Perera, Colombo (LK); Saman Kumara, Colombo (LK); Kanchana Gunasekera, Colombo (LK); Chamika Gunasinghe, Colombo (LK); Dinushka Deshappriya, Colombo (LK)

(73) Assignee: MAS INNOVATION (PRIVATE) LIMITED, Colombo (LK)

( * ) Notice: Subject to any disclaimer, the term of this patent is extended or adjusted under 35 U.S.C. 154(b) by 0 days.

(21) Appl. No.: 16/875,396

(22) Filed: May 15, 2020

(65) Prior Publication Data

US 2020/0338912 A1 Oct. 29, 2020

Related U.S. Application Data

(63) Continuation of application No. 15/757,945, filed as application No. PCT/SG2016/050437 on Sep. 7, 2016, now Pat. No. 10,696,071.

(30) Foreign Application Priority Data

Sep. 7, 2015 (GB) ..... 1515777

(51) Int. Cl.

| | |
|---|---|
| ***B41J 3/407*** | (2006.01) |
| ***B41J 11/06*** | (2006.01) |
| ***B41J 3/28*** | (2006.01) |

(52) U.S. Cl.

CPC ..... *B41J 11/06* (2013.01); *B41J 3/28* (2013.01); *B41J 3/4073* (2013.01); *B41J 3/4078* (2013.01)

(58) Field of Classification Search

CPC ... B41J 11/06; B41J 3/4078; B41J 3/28; B41J 3/4073

See application file for complete search history.

(56) References Cited

U.S. PATENT DOCUMENTS

| | | | |
|---|---|---|---|
| 4,688,101 | A | 8/1987 | Doelves et al. |
| 4,745,863 | A | 5/1988 | Takezaki |
| 5,327,827 | A | 7/1994 | Richardson |
| 6,059,391 | A | 5/2000 | Fulkerson et al. |
| 6,908,190 | B2 | 6/2005 | Iwatsuki et al. |

(Continued)

FOREIGN PATENT DOCUMENTS

| | | | |
|---|---|---|---|
| CN | 2189053 | Y | 2/1995 |
| CN | 2561584 | Y | 7/2003 |

(Continued)

OTHER PUBLICATIONS

Austrailian Examination Report dated Jun. 12, 2020, corresponding to Applicaion No. 2016321096.

(Continued)

*Primary Examiner* — Yaovi M Ameh

(74) *Attorney, Agent, or Firm* — Patterson + Sheridan, LLP

(57) ABSTRACT

Provided herein are platens for printing on an item of clothing, where the platens are adapted to enable the printing of a pattern on the item of clothing, such that the pattern may encircle the entire item of clothing in a seamless manner. Also disclosed herein is an apparatus that makes use of said platens and a method of printing with said platens.

9 Claims, 6 Drawing Sheets

(56) References Cited

U.S. PATENT DOCUMENTS

| | | | | |
|---|---|---|---|---|
| 7,607,745 | B2 | 10/2009 | Ben-Zur | |
| 8,177,442 | B2 | 5/2012 | Abbott et al. | |
| 8,205,981 | B1 | 6/2012 | Marino et al. | |
| 8,256,889 | B1 | 9/2012 | Abbott et al. | |
| 8,465,143 | B1 | 6/2013 | Marino et al. | |
| 8,465,144 | B2 | 6/2013 | Marino et al. | |
| 8,807,031 | B2 | 8/2014 | Styles et al. | |
| 8,870,330 | B1 | 10/2014 | Borrell Avila et al. | |
| 8,881,652 | B2 | 11/2014 | Middo et al. | |
| 2004/0179081 | A1 | 9/2004 | Nimi et al. | |
| 2004/0189776 | A1 | 9/2004 | Niimi et al. | |
| 2009/0120309 | A1 | 5/2009 | Szyszko | |
| 2013/0017330 | A1* | 1/2013 | Padilla | B41J 11/06 427/256 |
| 2013/0057612 | A1 | 3/2013 | Song et al. | |
| 2013/0278692 | A1 | 10/2013 | Marino et al. | |
| 2013/0335464 | A1 | 12/2013 | Gerber | |
| 2014/0196661 | A1 | 7/2014 | Walker | |
| 2014/0232040 | A1* | 8/2014 | Leedy | A43B 3/0084 264/293 |
| 2014/0354748 | A1 | 12/2014 | Pope | |
| 2015/0151551 | A1* | 6/2015 | Livingston | B41J 11/06 347/110 |

FOREIGN PATENT DOCUMENTS

| | | | |
|---|---|---|---|
| CN | 1844559 | A | 10/2006 |
| CN | 1970307 | A | 5/2007 |
| CN | 102259517 | A | 11/2011 |
| CN | 102909946 | A | 2/2013 |
| CN | 103774468 | A | 5/2014 |
| CN | 203831996 | U | 9/2014 |
| CN | 104343025 | A | 2/2015 |
| CN | 104379353 | A | 2/2015 |
| CN | 104856300 | A | 8/2015 |
| CN | 108349267 | A | 7/2018 |
| EP | 0526239 | A2 | 2/1993 |
| EP | 2128330 | A1 | 12/2009 |
| FR | 2308508 | A1 | 11/1976 |
| GB | 1256745 | A | 12/1971 |
| GB | 1328885 | A | 9/1973 |
| GB | 2068836 | A | 8/1981 |
| GB | 2171644 | A | 9/1986 |
| JP | 2004-262214 | A | 9/2004 |
| JP | 2007-031888 | A | 2/2007 |
| JP | 2010-059563 | A | 3/2010 |
| JP | 2010-083040 | A | 4/2010 |
| WO | 01/08889 | A1 | 2/2001 |
| WO | 03/093014 | A1 | 11/2003 |
| WO | 2011/092927 | A1 | 8/2011 |
| WO | 2013/192363 | A1 | 12/2013 |

OTHER PUBLICATIONS

Chinese Third Office Action dated Jun. 9, 2020, corresponding to Applicaion No. 2016800605815.

Great Britain Examination Report dated Apr. 23, 2020, corresponding to Application No. GB1804078.2.

Japanese Office Action dated Sep. 7, 2020, corresponding to Application No. 2018-512336.

European Office Action dated Feb. 20, 2020, corresponding to Application No. 16778125.1.

Chinese Office Action dated Dec. 26, 2019, corresponding to Application No. 2016800605815.

Chinese Office Action dated May 21, 2019, corresponding to Application No. 2019051601144610.

Chinese search report dated Nov. 24, 2020, corresponding to Application No. 201680060581.5.

Final Japan Office Action dated Dec. 15, 2020, corresponding to Application No. 2018-512336.

Fourth Chinese Office Action dated Dec. 2, 2020, corresponding to Application No. 201680060581.5.

Great Britain Search Report dated Jan. 26, 2016, corresponding to Application No. GB1515777.9.

International Search Report and Written Opinion issued in corresponding application PCT/SG2016/050437, dated Jan. 30, 2017.

* cited by examiner

DEVICE FOR DIRECT TO GARMENT PRINTING

CROSS-REFERENCE TO RELATED APPLICATIONS

This application is a continuation of U.S. patent application Ser. No. 15/757,945, filed on Mar. 6, 2018, which is a 371 National Phase Application of International Patent Application No. PCT/SG2016/050437, filed Sep. 7, 2016, which claims benefit and priority to Great Britain Application No. 1515777.9, filed Sep. 7, 2015, the contents of which are herein incorporated by reference in their entireties.

BACKGROUND

Field

This invention relates to a platen for direct to clothing (DTC) or direct to garment (DTG) printing, an apparatus containing said platen and associated methods.

Description of the Related Art

The listing or discussion of a prior-published document in this specification should not necessarily be taken as an acknowledgement that the document is part of the state of the art or is common general knowledge.

The apparel industry has recently entered the age of "Fast Fashion", where turn-around times are key to market success. Being able to respond quickly to fickle consumer trends will provide a decisive competitive advantage in the apparel sector to both manufacturers and retailers. The use of ink-jet printing technology to accelerate garment sample development and facilitate faster and more cost-effective small-scale production runs shows great promise. This type of printing is known as direct to garment (or DTG) printing. In addition, the use of DTG printing to print onto premade garments may result in significant time- and cost-savings over current production and logistical methods. This is because DTG printing can be applied on a garment at, or very close to, the point of sale.

However, current DTG printers are limited to providing and image, pattern or block of colour onto a single surface of a garment, such as a T-shirt. As such, current DTG printers are used to embellish part of one surface of a garment and cannot currently be effectively used to provide a pattern or colour across an entire garment's outer surface. This is because any attempt to use a current commercially available printer will result in a noticeable seam and, potentially, a misalignment of the pattern to be printed across the entire surface of the garment. This is aesthetically unpleasing and results in reduced consumer satisfaction with the resulting garment.

There remains a need to provide improved DTG printers that can deliver seamless and, potentially, fully-aligned patterns across the surface of a garment. Such printers would enable manufacturers and retailers to respond very quickly to changing fashion trends and demand on a more local level, potentially resulting in greater profit and less wastage of materials.

SUMMARY

The current invention provides a direct to clothing (DTC) platen that enables wrap-around printing of an item of clothing to be achieved. A DTC printing system that makes use of said platen is also provided. An item of clothing having a wrap-around print is also provided.

Aspects and embodiments of the invention will now be discussed below.

In a first aspect of the invention, there is provided a platen for printing on an item of clothing, wherein the platen comprises:

a first planar surface;

a second planar surface, the second planar surface opposite to the first planar surface and separated from the first planar surface in an axial direction; and at least one peripheral region extending from the first planar surface to the second planar surface, wherein the platen further comprises a tapered region comprising a tapered edge formed on at least part of the at least one peripheral region.

In a second aspect of the invention, there is provided a platen for printing an item of clothing. The platen comprises a plurality of elongate segments, each segment comprising a tapered region comprising a tapered edge, the tapered edges being configured to hold an item of clothing in a taut arrangement for printing.

In embodiments of the first and second aspects of the invention:

(a) the tapered edge may a double-sided tapered edge;

(b) a minimum thickness of the tapered edge formed on the tapered region may be from 0.5 mm to 150 mm (e.g. from 0.5 mm to 50 mm, from 0.7 to 5 mm, or from 1 to 3 mm, such as 2 mm);

(c) for embodiments of the first aspect of the invention, a maximum separation of the first and second planar surfaces may be from 0.5 mm to 50 mm (e.g. from 0.7 mm to 5 mm, or from 1 to 3 mm, such as 2 mm);

(d) the at least one tapered region may have a width of from 2 mm to 100 mm (e.g. from 2.5 to 10 mm, or from 3 mm to 5 mm, such as 4 mm);

(e) the at least one tapered region may have a taper angle of from 0.1° to 89.5° (e.g. from 45° to 85°, such as from 70° to 80°, such as 78°)

(f) for embodiments of the first aspect of the invention, the first and second planar surfaces may further comprise an absorbent material.

In a third aspect of the invention, there is provided a platen for printing on an item of clothing, wherein the platen comprises:

a first planar surface;

a second planar surface, the second planar surface opposite to the first planar surface and separated from the first planar surface in an axial direction; and at least one peripheral region extending from the first planar surface to the second planar surface, wherein the platen further comprises a means or apparatus to transfer part of an item of clothing disposed on the first surface of the platen onto the second surface of the platen.

In one embodiment of this aspect, the means or apparatus to transfer part of an item of clothing disposed on the first surface of the platen onto the second surface of the platen may be at least one edge flipping mechanism attached to the at least one peripheral region. In an alternate embodiment of this aspect, the means or apparatus to transfer part of an item of clothing disposed on the first surface of the platen onto the second surface of the platen may be at least one toothed rotary actuator mechanism attached to the peripheral region of the platen.

In embodiments of the third aspect of the invention:

(a) the peripheral edge may further comprise one or more extendible sections for stretching an item of clothing (e.g.

using springs or pneumatics and/or where the extendible sections may be manually controlled, automated or self-adjusting (e.g. by spring-tension));

(b) the platen may be made from one or more materials selected from the group consisting of a metal (e.g. aluminium, stainless steel), a fiber glass and a composite material (e.g. a carbon composite material);

(c) the platen may be a direct to clothing platen.

In a fourth aspect of the invention, there is provided a printing system comprising a platen as described in the first, second, or third aspects of the invention and technically sensible combinations of embodiments thereof, a template for alignment of the platen, and a printer.

In embodiments of the system:

(a) the system may further comprise a means or apparatus to automatically rotate the platen from a first position having a first surface exposed to the printer to a second position having a second surface exposed to the printer;

(b) the system may further comprise an integral means or apparatus for curing an ink and/or an item of clothing after printing, optionally wherein the means or apparatus for curing is an apparatus to generate hot air or an infra-red lamp;

(c) the system may be a direct to clothing system;

(d) the platen may be a direct to clothing platen.

In a fifth aspect of the invention, there is provided a method of printing on an item of clothing, comprising placing an item of clothing on a platen as described in the first to third aspects of the invention and any technically sensible combination of embodiments thereof, printing on a first section of the item of clothing corresponding to the first planar surface of the platen, and printing on a second section of the item of clothing corresponding to the second planar surface of the platen.

In a sixth aspect of the invention there is provided an item of clothing comprising an external surface comprising at least one wrap-around printed pattern, wherein the pattern does not exhibit a seam caused by printing. In certain embodiments, of the invention the item of clothing is obtained or obtainable by a direct to clothing printing process.

DETAILED DESCRIPTION

Figure 1A:
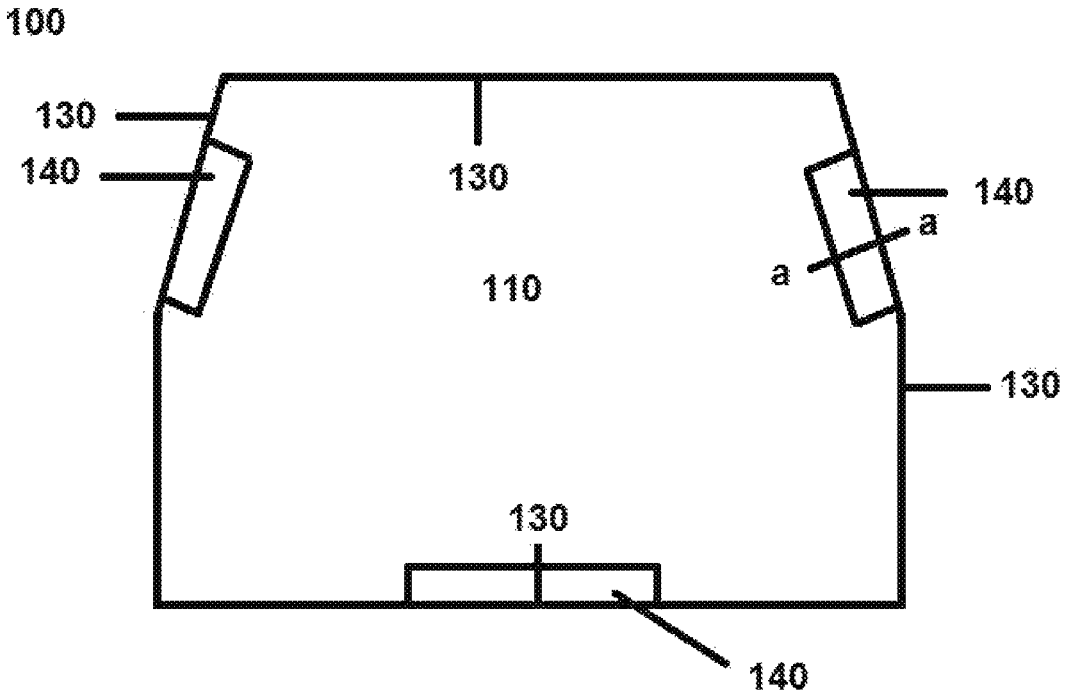
FIG. 1*a* depicts a plan view of a platen according to a first embodiment of the current invention.

Example embodiments of the invention will now be described more fully hereinafter with reference to the accompanying drawings; however, the invention may be embodied in different forms and should not be construed as limited to the embodiments set forth herein. Rather, these embodiments are provided so that this disclosure will be thorough and complete, and will fully convey example implementations to those skilled in the art.

In the drawing figures, the dimensions of layers and regions may be exaggerated for clarity of illustration. Like reference numerals refer to like elements throughout.

As the invention allows for various changes and numerous embodiments, particular embodiments will be illustrated in the drawings and described in detail in the written description. However, this is not intended to limit the present invention to particular modes of practice, and it will to be appreciated that all changes, equivalents, and substitutes that do not depart from the technical scope are encompassed in the present invention. In the description, certain detailed explanations of related art are omitted when it is deemed that they may unnecessarily obscure the essence of the invention. While such terms as "first," "second," etc., may be used to describe various components, such components must not be limited to the above terms. The above terms are used only to distinguish one component from another. The terms used in the present specification are merely used to describe particular embodiments, and are not intended to limit the present invention. An expression used in the singular encompasses the expression of the plural, unless it has a clearly different meaning in the context. In the present specification, it is to be understood that the terms such as "including" or "having," etc., are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added. Also, expressions such as "at least one of," when preceding a list of elements, modify the entire list of elements and do not modify the individual elements of the list.

In embodiments herein, the word "comprising" may be interpreted as requiring the features mentioned, but not limiting the presence of other features. Alternatively, the word "comprising" may also relate to the situation where only the components/features listed are intended to be present (e.g. the word "comprising" may be replaced by the phrases "consists of" or "consists essentially of"). It is explicitly contemplated that both the broader and narrower interpretations can be applied to all aspects and embodiments of the present invention. In other words, the word "comprising" and synonyms thereof may be replaced by the phrase "consisting of" or the phrase "consists essentially of" or synonyms thereof and vice versa.

As mentioned hereinbefore, the current invention relates to a direct to clothing platen for printing on an item of clothing, wherein the platen comprises:

a first planar surface;

a second planar surface, the second planar opposite to the first planar surface and separated from the first planar surface in an axial direction; and at least one peripheral region extending from the first planar surface to the second planar surface, wherein the platen further comprises a tapered region comprising a tapered edge formed on at least part of the at least one peripheral region.

It is believed that the tapered region (and more specifically the tapered edge, e.g. a double-sides tapered edge) of the platen described herein enables the seamless printing of a wrap-around patterns on an item of clothing.

When referred to herein, "pattern" refers to any printed shape that is applied to an item of clothing by a direct to clothing (DTC) printer that makes use of the platen of the current invention. The pattern may be a distinctive shape, whether repeating or not, or may be a monolithic block of colour. When referred to herein, a "wrap-around" refers to printing a pattern on at least part of the front, back and sides of an item of clothing. In other words, the pattern is present on all three sides—front, back and at least one side of an item of clothing.

When used herein "seamlessly", when used in relation to DTC printing, refers to there being no visible gap and/or misalignment between the printed portions of the pattern when applied to the item of clothing. For example, when the item of clothing applies a pattern in the form of a dragon that circles the item of clothing from the front to the back, there is no gap or misalignment between the various sections that are applied by DTC printing to provide the dragon. In other words, as the dragon circles the item of clothing, there is no gap or misalignment in the printing between the front, back and sides of the printed-upon garment.

When used herein "clothing" and "an item of clothing", relate to any 3-dimensional, thin and flexible substrate that may be used to conform to a whole or part of a 3-dimensional object, whether animate (e.g. a human or an animal, such as a companion animal) or inanimate (e.g. a bed, a sofa, a chair, a pillow etc). Examples of clothing that may be mentioned herein include, but are not limited to, pillowcases, bed sheets, sweaters, gloves, wrist bands, head bands, shorts, jeans, trousers, leggings, pet wear, ties, caps, tea cosies and beer cosies. In embodiments that may be mentioned herein, the clothing may be sweaters, gloves, wrist bands, head bands, shorts, jeans, trousers, leggings, and pet wear.

In certain embodiments of the invention, the terms "clothing" and "an item of clothing" may also be used to refer to a bag. Said bag may be a 3-dimensional, thin and flexible substrate, such as an unstructured bag (e.g. a tote bag). It will be appreciated that the materials used to make the items of clothing may be any suitable material that can be printed upon.

When used herein, the terms direct to garment (DTG) and direct to clothing (DTC) may be used interchangeably.

For the avoidance of doubt, while the platen and the systems and methods described herein may be particularly suited to the provision of a seamless wrap-around print on clothing, they are also suitable for use in other printing activities as well. For example, the platen may be suitable for use in the printing of a pattern on only one surface of clothing or a planar item (e.g. one or both sides of a scarf or a towel). Additionally, the platen may be suitable for printing on the whole or part of a face of a structured item, such as a structured bag (e.g. a Birkin™ bag).

As mentioned hereinbefore, an objective of the current invention is to provide a means or apparatus to seamlessly print a wrap-around pattern on the item of clothing. In the embodiment discussed above, this may be achieved by a platen that has a tapered region comprising a tapered edge formed on at least part of the at least one peripheral region. An example embodiment of said platen is depicted in FIGS. 1*a* and 1*b*.

Figure 1B:
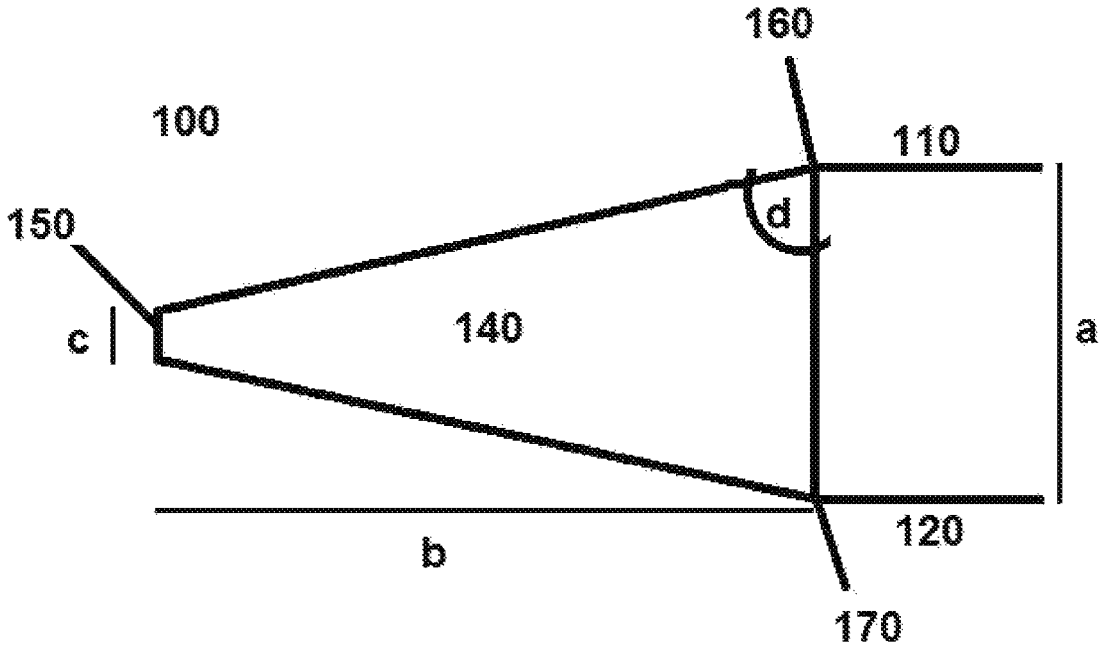
FIG. 1*b* depicts a cross section of a tapered edge of a platen according to the first embodiment of the current invention along line a-a.

Referring to FIG. 1*a* and FIG. 1*b*, there is shown a DTG platen 100 having a first planar surface 110 and a second planar surface 120 opposite to the first planar surface and separated from the first planar surface in an axial direction and four peripheral regions 130, each of which extend from the first planar surface to the second planar surface. The platen embodied in FIGS. 1*a* and 1*b* enables a wrap-around pattern to be seamlessly printed on an item of clothing such as a pantie by use of three tapered edges 150, formed in three tapered regions 140 on three peripheral regions 130, two of which are opposing (i.e. to support the sides of the pantie), with the other peripheral region there between (i.e. to support the seat of the pantie).

The embodiment of FIGS. 1*a* and 1*b* may be particularly suitable for use in the wrap-around printing of an item of clothing, such as a pantie. When a pantie is placed onto the platen 100, the pantie becomes stretched over at least some of the peripheral regions of the platen, with the tapered regions being designed to come into close contact with the stretched portions of the pantie (i.e. sides and seat of the pantie), such that the tapered edges 150 stretch the pantie even further at the point of contact. The pantie may then be subjected to DTG printing using the first surface of the platen 110, such that a first side of the pantie is covered, followed by printing on the second surface of the platen to provide a pantie that has a wrap-around and seamless pattern applied to it. In contrast, the use of a similar platen having non-tapered edges (e.g. flat or rounded edges) in DTG printing resulted in a pantie that has a wrap-around pattern applied to it, but where the seam caused by printing on the first and second sides of the pantie are visible.

It will be appreciated that a platen of the current invention may have any suitable shape, provided that the shape enables the seamless wrap-around DTG printing of an item of clothing, further the platen may be formed from a plurality of parts.

Figure 2A:
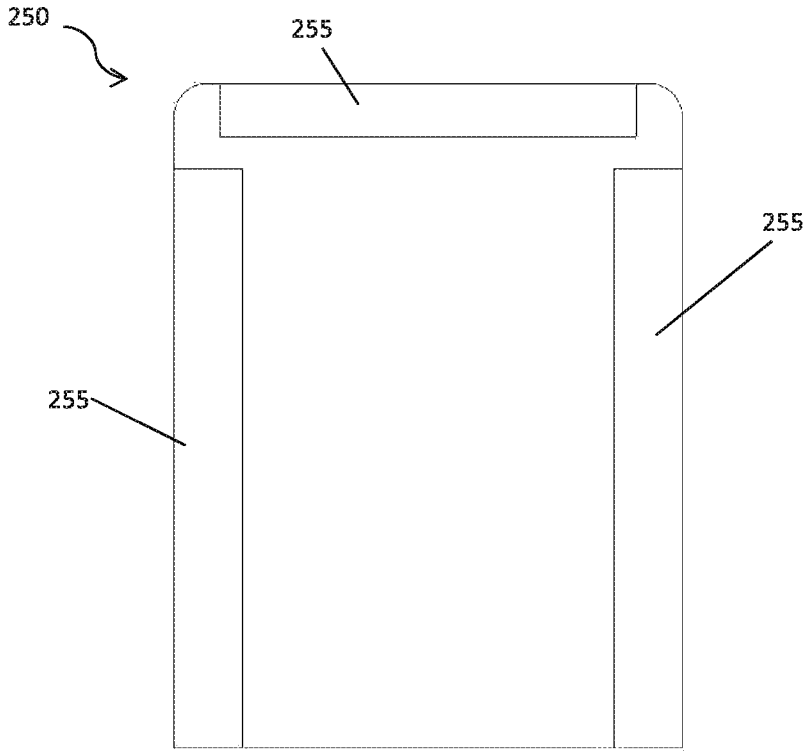
FIG. 2*a* shows an example of a platen for printing on tank tops and/or vests.

FIG. 2*a* shows an example of a platen for printing on tank tops and/or vests. The platen 250 has tapered regions 255 on the top edge and on the side edges. It will be appreciated that these tapered regions also comprise a tapered edge.

Figure 2B:
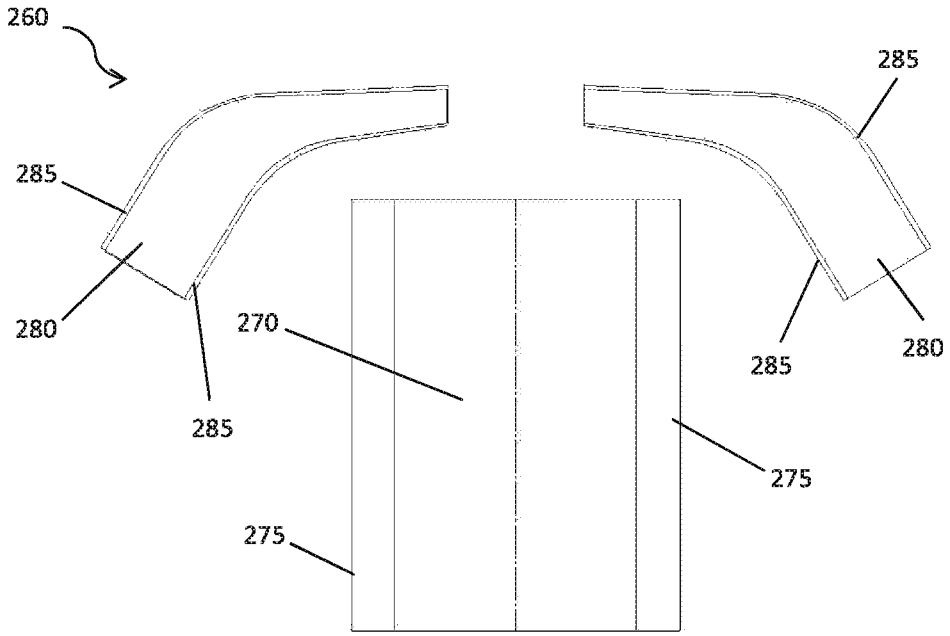
FIG. 2*b* shows an example of platen formed from a plurality of parts for printing on T-shirts.

FIG. 2*b* shows an example of platen formed from a plurality of parts for printing on T-shirts. The platen 260 is formed from three parts: a body part 270 and two arm parts 280. The body part 270 is rectangular and has tapered regions 275 running along the full length of the side edges. The arm parts 280 have portions shaped to correspond to the arms of a T-shirt and have tapered regions 285 running along the top of bottom edges. It will be appreciated that these tapered regions also comprise a tapered edge.

In the embodiment of FIGS. 1*a* and 1*b*, the platen is provided with four peripheral regions 130, three of which contain tapered regions 140. It will be appreciated that the tapered platens of the current invention may contain one or more peripheral regions (e.g. from one to twenty, such as one to ten, such as from one to eight, such as from four to six peripheral regions) and that each of said peripheral regions may contain one or more tapered regions (e.g. from one to four, such as from one to two, such as one tapered region(s)) that cover whole or part of said peripheral region. For example, as shown in FIG. 2*b*, each part of the platen has four peripheral regions, with two of these peripheral regions also containing a tapered region.

As shown in FIG. 1*b* (which is a cross-section taken along line a-a of FIG. 1*a*), the tapered edges 150 may be double-sided. That is, the tapered region has two tapers, one extending from the first surface 110 and one extending from the second surface 120 that meet to form the tapered edge 150. In other embodiments of the invention that may be mentioned herein, the tapered edges may be single sided, such that the tapered region only has one taper extending from the first surface 110 or the second surface 120 of the platen 100.

Referring to FIG. 1*b*, the platen has a maximum separation (a) between the first and second surfaces. In embodiments of the invention relating to tapered platens, the maximum separation of the first and second planar surfaces (a) may be from 0.5 mm to 150 mm (e.g. from 0.5 mm to 50 mm, from 0.7 to 5 mm, or from 1 to 3 mm, such as 2 mm). In particular embodiments of the invention, the maximum separation of the first and second planar surfaces (a) may be 2 mm. While the embodiment in FIG. 1*b* depicts the first and second surfaces of the platen in a substantially parallel arrangement, it will be appreciated that the first and second surfaces do not need to be parallel, provided that these surfaces enable a continuous print to be applied to an item of clothing.

As shown in FIG. 1*b*, the tapered region(s) of the platen has a width (b), which may be measured from the beginning of the taper on the first 160 and/or second 170 surface to the tip of the tapered edge 150. In embodiments of the invention relating to tapered platens, the width (b) of the tapered region(s) of the platen may be from 2 mm to 100 mm (e.g. from 2.5 mm to 10 mm, or from 3 mm to 5 mm). In particular embodiments of the invention, the width (b) of the tapered region(s) of the platen may be 4 mm.

As depicted in FIG. 1*b*, the tapered edge 150 has a minimum thickness (c), which is at the apex of the tapered edge. In embodiments of the invention relating to tapered platens, the minimum thickness (c) of the tapered edge formed the tapered region(s) is from 0.1 to 5 mm (e.g. from 0.5 to 0.5 mm, or from 0.2 to 0.4 mm). In particular embodiments of the invention, the minimum thickness (c) of the tapered edge may be 0.3 mm.

Finally, as shown in FIG. 1*b*, the taper formed in the tapered region has an angle of taper (d) that may be measured by reference to the beginning of the taper on the first 160 and/or second 170 surface. In embodiments of the invention relating to tapered platens, the angle of taper (d) may be from 0.1° to 89.9° (e.g. from 45° to 85°, such as from 70° to 80°). In particular embodiments of the invention that may be mentioned herein, the angle of taper (d) may be 78°.

It will be appreciated that the dimensions and angles referred to hereinbefore may be used in any combination whatsoever and apply equally to single- and double-sided tapered edges. For example, the platen may have a double-sided tapered edge 150 and have a maximum separation of the first and second planar surfaces of 2 mm, a width (b) of the tapered region(s) of 4 mm, a minimum thickness (c) of the tapered edge of 0.3 mm and an angle of taper (d) of 78°.

The platens of the invention may be made using a metal such as aluminium or stainless steel. Alternatively, the platens may be made using a fiber glass or a composite material (e.g. a carbon composite material). It will be appreciated that combinations of these materials may be used to make portions of the platen. For example, stainless steel may be used to make the tapered regions of a tapered platen, with the remaining parts of the platen being made out of a carbon composite material. In particular embodiments of the invention that may be mentioned herein, the tapered platen may be made from aluminium. For the avoidance of doubt, platens of the invention comprising a means or apparatus to transfer part of an item of clothing disposed on the first surface of the platen onto the second surface of the platen may be made of similar materials.

In certain embodiments of the invention, the platen may be expandable. That is, and as exemplified by FIG. 3*a*, the platen may contain sections 180, 181 that can expand to better fit the size of the item of clothing that is to be printed, such that the item of clothing is stretched more fully to enable a better wrap-around print. Platens according to these embodiments may contain one or more mechanisms 190 for expanding the sections 180, 181 to fit the item of clothing. This may be done manually or automatically before fitting the item of clothing to the platen 100. Alternatively, the platen may also contain a force-feedback mechanism to determine the ideal tension that the attached item of clothing requires for optimal printing. This force-feedback mechanism allows the platen to automatically adjust its size, and thereby the tension applied to the item of clothing, to the optimal level, thereby removing the need to manually determine the ideal tension for the attached item of clothing beforehand. In addition, the same force feedback mechanism may also be used to detect which sections of the platen are in contact with the garment and then expand only those sections, as it is only the sections that are in contact with the item of clothing that need to be expanded to enable optimal printing of the item of clothing. This may reduce the number of different platens that are needed to print various similar items of clothing of differing sizes.

It will be appreciated that the expandable sections may operate using any suitable means. For example, the expandable sections may be controlled using springs or pneumatics and the extendible sections may be manually controlled, automated or self-adjusting (e.g. by spring-tension).

Figure 3A:
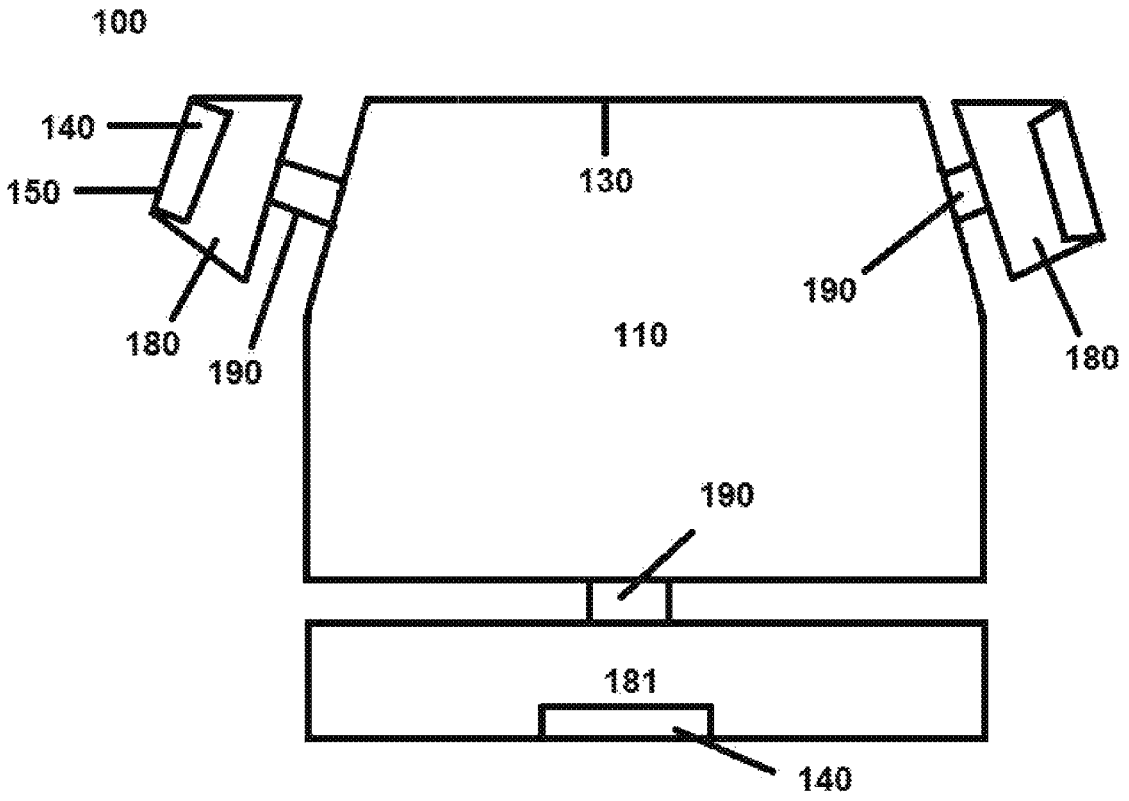
FIGS. 3*a* and 3*b* depict plan views of platens according to embodiments of the current invention.

As shown in FIG. 3*a*, the mechanisms 190 for expanding the sections 180, 181 do not need to have the same width as the section 180, 181 it is attached to. Provided that the clothing is stretched taut at the points of contact with the sections 180, 181 (i.e. the tapered regions 140) there is no need for the clothing to rest on a fully flat surface on a platen. This is because the platen may be used with a printer head that does not come into physical contact with clothing on the platen when a printed pattern is applied. For example, when an inkjet printer head is used, the inkjet droplets that come into contact with the clothing to form the pattern will not cause a distortion of the pattern provided that the clothing is stretched taut by the tapered regions 140 which are held in position by the expandable regions. In certain embodiments, all areas of the garment that are on the tapered edges may need to be supported along their entire length (e.g. for undergarments, the sides connecting the waistband and gusset should be supported along their entire length, as should the edge of the gusset).

The platens depicted in FIGS. 1 to 3*a* include a first and second surface (e.g. 110, 120 according to FIG. 1*b*), said surfaces may further comprise an absorbent material. Said absorbent material may be mounted, integrated or applied to the surfaces (110, 120) in order to prevent wet ink that may be on the surfaces (110, 120) from transferring onto the garment while it is being removed from the platen, which may otherwise result in smudging or spoiling of the pattern.

Figure 3B:
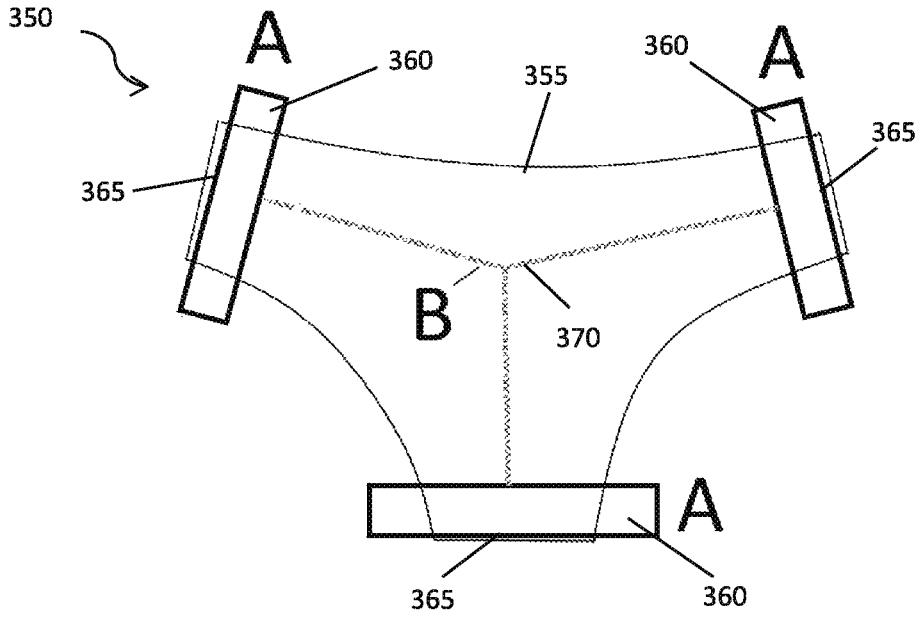

In an embodiment, the platen may comprise a plurality of edge portions which are configured to hold a garment in a taut configuration. FIG. 3*b* shows a platen 350 which holds an item of clothing 355 in a taut configuration for printing. The platen comprises three segments 360 which are labelled A in FIG. 3*b* and a truss 370 which is labelled B in FIG. 3*b*. The truss may be spring loaded to hold the segments 360 in position and the garment in the taut configuration. The segments 360 each have an edge 365 which comprises a tapered portion. The tapered portions are arranged where the edge portions 365 of the segments 360 are in contact with the item of clothing. As described above in relation to FIG. 3*a*, the item of clothing is held taut by the edge portions of the segments and does not require a surface behind all of the area which is printed.

In alternative embodiments of the invention, the platen may use a means or apparatus to transfer part of an item of clothing disposed on the first surface of the platen onto a second surface of the platen in order to seamlessly print a wrap-around pattern on an item of clothing.

In certain embodiments, the means or apparatus to transfer part of an item of clothing disposed on the first surface of the platen onto the second surface of the platen may be at least one edge flipping mechanism attached to the peripheral region of the platen. An example of these embodiments is provided by FIG. 4.

Figure 4:
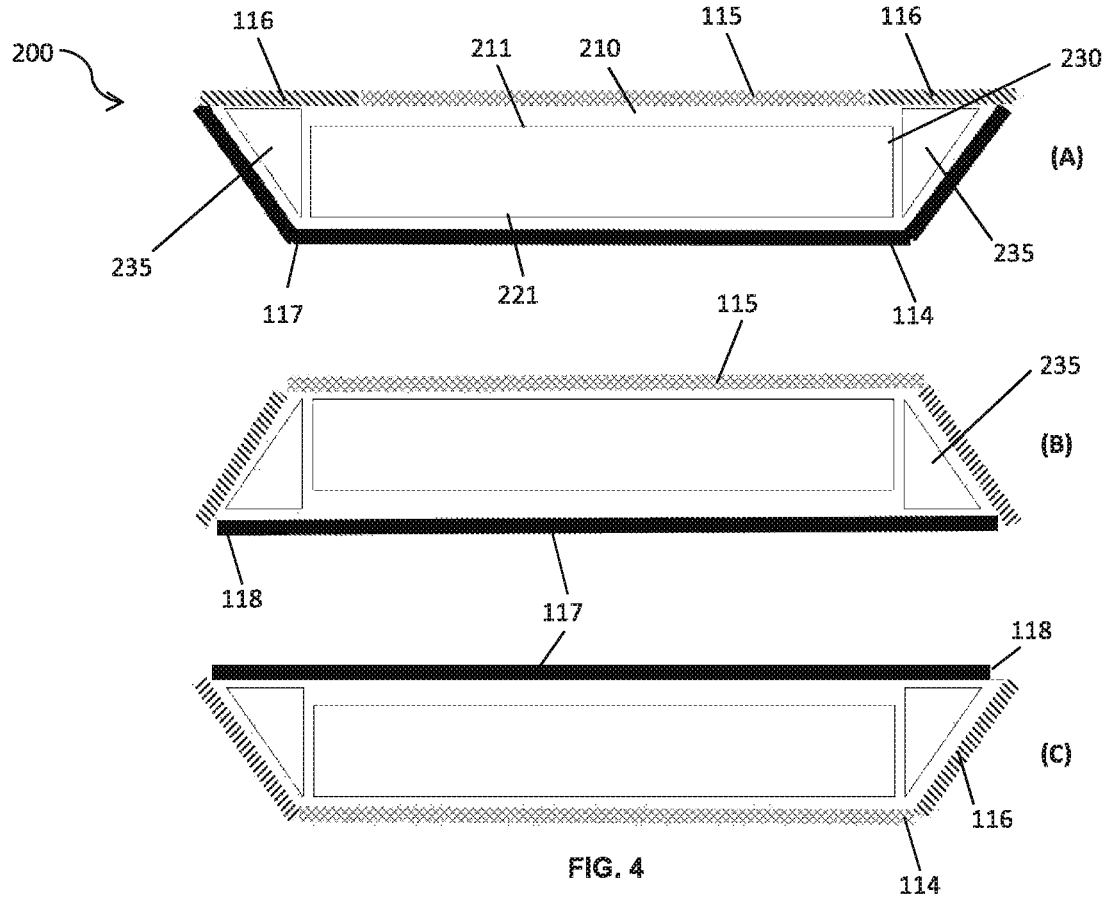
FIG. 4 depicts a cross-sectional view of a platen according to an embodiment of the current invention.

FIG. 4 (A-C) depicts a platen having an edge flipping mechanism according to the invention with an item of clothing disposed thereon. In FIG. 4A, the platen 200 has a first planar region 211 and a second planar region 221 and has a peripheral region 230 extending from the first planar region to the second planar region. The peripheral region contains an edge flipping mechanism 235 attached thereto. The first planar surface 210 may be formed by the first planar region 211 and part(s) of the edge flipping mechanism 235 (e.g. as shown in FIG. 4A) and the second planar surface is formed by the second planar region 221 and part(s) of the edge flipping mechanism 235 (e.g. the same part(s) of the edge flipping mechanism 235, as shown in FIGS. 4B and 4C). When an item of clothing 114 is placed on the platen of FIG. 4A, a first portion 115 of a first face of the item of clothing is disposed on the first planar region 211 of the platen and second portions 116 of the first face of the item of clothing are disposed on the flipping mechanism 235 disposed in the peripheral region 230 of the platen. A second face 117 of the item of clothing is partly disposed on the second planar region 221 and partly disposed on the flipping mechanism 235. The flipping mechanism in FIG. 4A is presented in a first configuration, such that the second portions 116 of the first face of the item of clothing 114 in contact with the flipping mechanism are substantially planar with the first portion 115 of the first face of the item of clothing located on the first planar region 211 of the platen 210, which allows a continuous print across the entire first face of the item of clothing. Following DTG printing on the first surface of the item of clothing 114, the flipping mechanism transitions to a second configuration as shown in FIG. 4B, thereby bringing part 118 of the second portions 116 of the first face of the item of clothing 114 into planar alignment with the second planar region 221 of the platen 200, such that a seamless wrap-around print may be accomplished following (optional) flipping of the platen, as shown in FIG. 4C.

As shown in FIGS. 4A and 4C, the flipping mechanisms 235 extend above the surface defined by the first planar region 211 (FIG. 4A) or the second planar region 221 (FIG. 2B), such that the item of clothing 114 is stretched taut by the flipping mechanisms 235 to provide a substantially flat surface for printing on.

As will be appreciated, the actual number of flipping mechanisms 235 that are employed may vary depending on the item of clothing that is to be printed. These flipping mechanisms may operate in concert with one another or may operate independently, depending on the item of clothing to be printed. In common with the tapered platens described hereinbefore, the flipping mechanism may be attached to expandable sections of the platen.

In certain embodiments, the means or apparatus to transfer part of an item of clothing disposed on the first surface of the platen onto the second surface of the platen may be at least one toothed rotary actuator mechanism attached to the peripheral region of the platen. An example of these embodiments is provided by FIG. 5.

Figure 5:
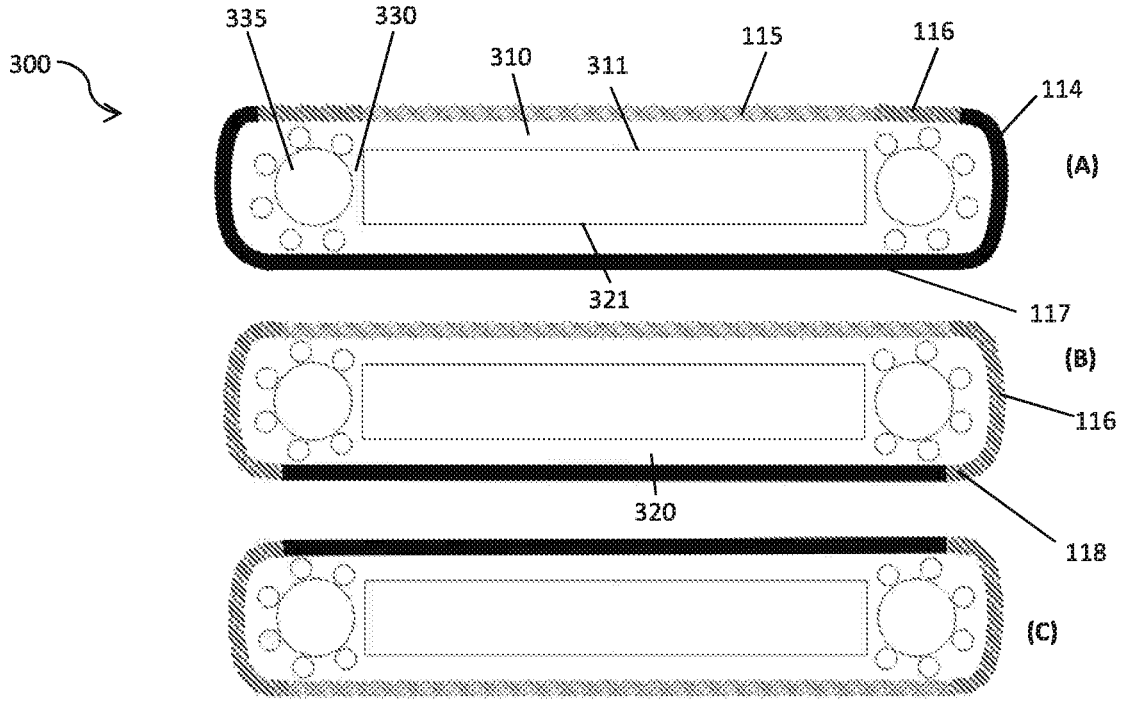
FIG. 5 depicts a cross-sectional view of a platen according to an embodiment of the current invention.

FIG. 5 (A-C) depicts a platen 300 having two toothed rotary actuator mechanisms according to the invention with an item of clothing disposed thereon. In FIG. 5A, the platen 300 has a first planar region 311 and a second planar region 321, and has a peripheral region 330 extending from the first planar region to the second planar region. The peripheral region 330 contains toothed rotary actuator mechanism attached thereto. The first planar surface 310 may be formed by the first planar region 311 and the rotary actuator mechanisms 335 in planar alignment with the first planar region 311 and the second planar surface 320 is formed by the second planar region 321 and the rotary actuator mechanisms 335 in planar alignment with the second planar region 321. When an item of clothing 114 is placed on the platen of FIG. 5A, a first face of the item of clothing is disposed on the first planar surface 310 of the platen, such that a first portion 115 is disposed on the first planar region 310 and second portions 116 of the first face of the item of clothing are disposed on the rotary actuator mechanisms 335 disposed in the peripheral region 330 of the platen. A second face 117 of the item of clothing is partly disposed on the second planar surface 320 and partly disposed on the flipping mechanism 335. The rotary actuator mechanisms in FIG. 5A are presented in a first configuration, such that the second portions of the first face 116 of the item of clothing 114 in contact with the rotary actuator mechanisms are substantially planar with the first portion 115 of the first face of the item of clothing located on the first planar surface of the platen 310, which allows a continuous print across the entire first face of the item of clothing. Following DTG printing on the first face of the item of clothing 114, the rotary actuator mechanisms transitions to a second configuration as shown in FIG. 5B, thereby bringing part 118 of the second portions 116 of the first face of the item of clothing 114 into planar alignment with the second planar surface 320 of the platen, such that a seamless wrap-around print may be accomplished following (optional) flipping of the platen, as shown in FIG. 5C.

As will be appreciated, the actual number of rotary actuator mechanisms that are employed may vary depending on the item of clothing that is to be printed. These rotary actuator mechanisms may operate in concert with one another or may operate independently, depending on the item of clothing to be printed. In common with the tapered platens described hereinbefore, the rotary actuator mechanism(s) may be attached to expandable sections of the platen.

The Embodiments shown in FIGS. 4 and 5 have been found to be particularly effective when used with fabric having a thickness of greater than 0.4 mm.

The platens described hereinbefore may be attached to a system for DTG printing. Said system may be a DTG printing system comprising a direct to item of clothing platen according to any embodiment of the invention as described hereinbefore, a template for alignment of the platen and a printer. In certain embodiments of the invention, the system may further comprise a means or apparatus to automatically rotate the platen from a first position having a first surface exposed to the printer to a second position having a second surface exposed to the printer. It will be appreciated that the platens described hereinbefore as aspects of the invention (and their embodiments) may be an integral part of the printer, such that the platen form the printer bed. In such embodiments, the rotation mechanism described above may also be integrated into the printer, though this need not be the case.

FIGS. 6*a* to 6*d* depict a system according to the current invention, wherein the system contains a platen 100 (which may be any platen according to the current invention), a template for alignment of the platen 410 and a printer (not depicted). In the embodiment depicted in FIGS. 6*a* to 6*d*, the system further comprises a mechanism 420 that automatically rotates the platen from a first position having a first surface exposed to the printer to a second position having a second surface exposed to the printer. The mechanism 420 comprises a holder 430 for the platen 100, a rotation device 440 and a device 450 for vertically removing and replacing the platen from the template 410. Following printing of an item of clothing on a first planar surface of a platen 100, the device 450 will lift the holder 430 and attached platen 100 off from the alignment template 410 to enable the rotation device to rotate the holder and platen to expose the second planar surface of the platen for printing. Following rotation, the holder and platen are returned to rest within the alignment template and the item of clothing disposed on the second planar surface of the platen 100 is printed. Thus, the system allows for a seamless wrap-around print of an item of clothing.

Figure 6A:
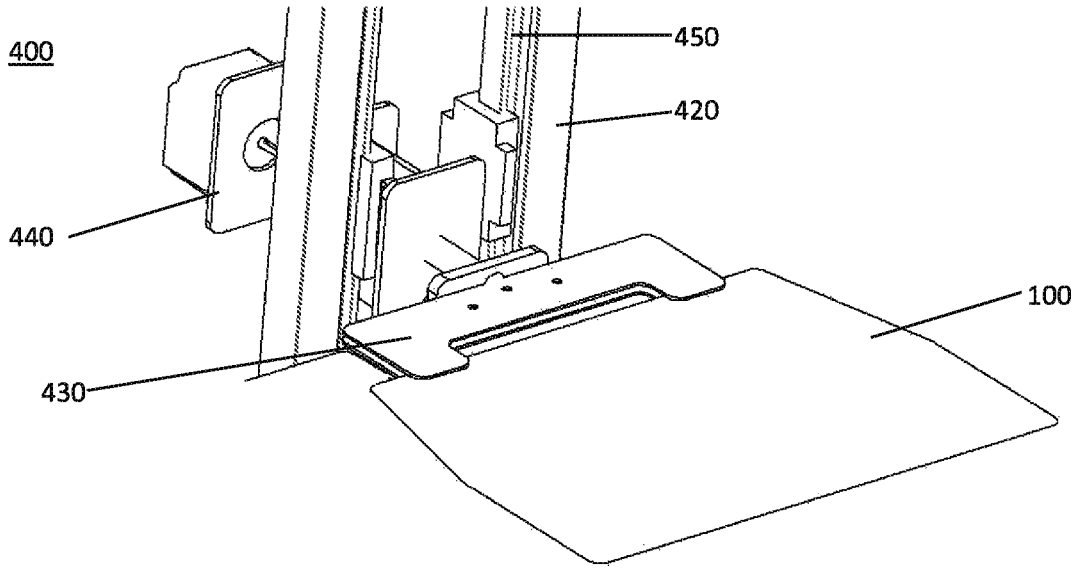
FIGS. 6*a* to 6*d* depict a system according to the current invention.
Figure 6B:
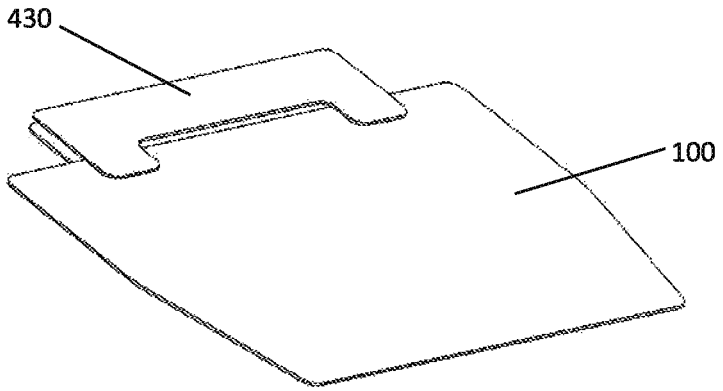
Figure 6C:
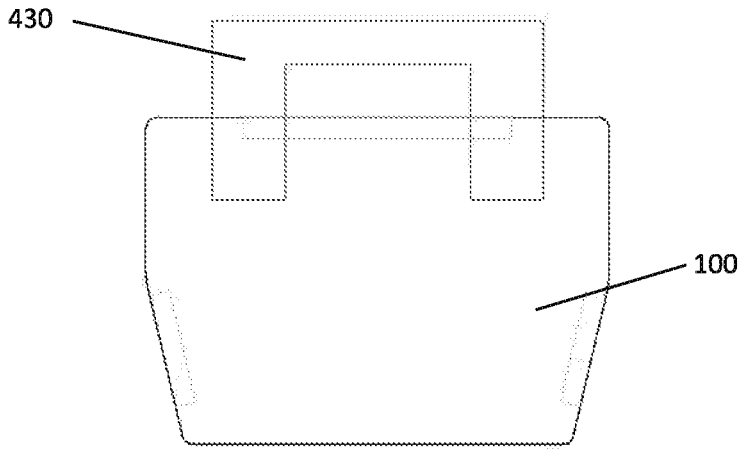
Figure 6D:
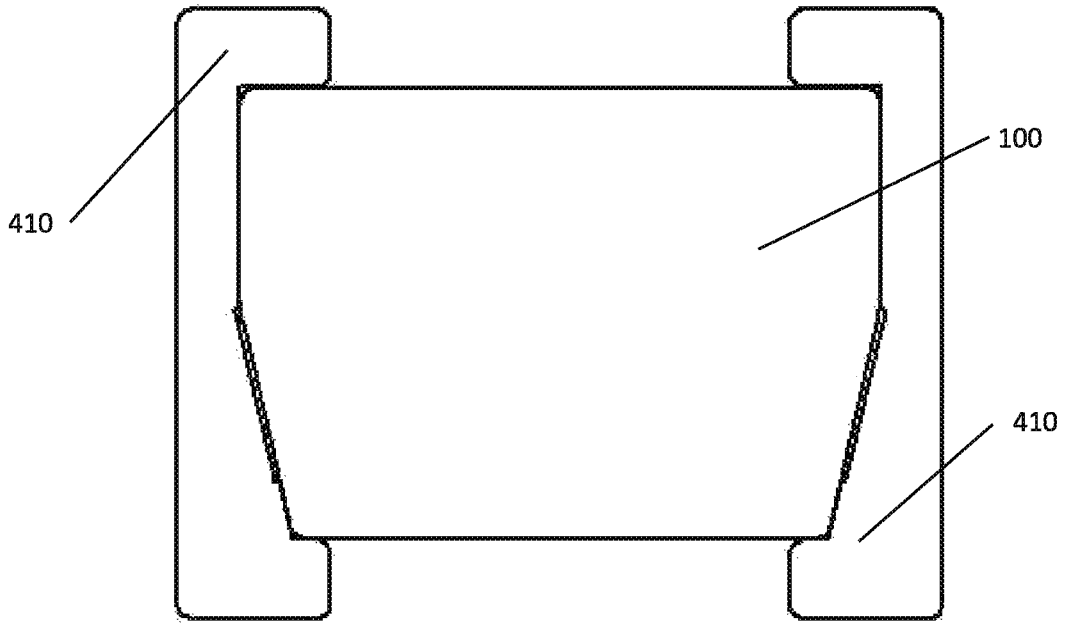

As depicted in FIG. 6*d*, the system may further comprise a template 410, upon which the platen and the holder rest. The template 410 can contain a custom cut-out matched to the shape of the platen to help prevent the platen from moving. The cut-out may contain relief sections that ensure that the item of clothing does not come into contact with another surface and smudge before curing. This helps to prevent non-uniform sections of the item of clothing (such as seams) creating an uneven surface on either side of the platen.

Although not shown, the system may also include an integrated curing means or apparatus for curing an ink and/or an item of clothing after printing, such as an apparatus to generate hot air or an infra-red lamp.

It will be appreciated that the printing on the first and second planar surfaces may be accomplished simultaneously. Alternatively, the printing on the first and second planar surfaces may be accomplished sequentially, such that printing is accomplished on the first planar surface, followed by printing on the second planar surface.

As noted hereinbefore, the platen, the system and the processes described above relate to the manufacture of an item of clothing. Thus, there is also provided an item of clothing comprising an external surface comprising at least one wrap-around printed pattern, wherein the pattern does not exhibit a seam caused by printing. In particular embodiments that may be mentioned herein, the item of clothing may be obtained or obtainable by a direct to clothing printing process. Such an item of clothing may be distinguishable over other items of clothing printed using different techniques by, amongst other things, simple hand-feel.

As mentioned hereinbefore, the item of clothing may be any thin and flexible substrate that has a 3-dimensional shape that may be used to cover whole or part of a 3-dimensional object. Such items of clothing may be pre-prepared and printed using the platen and techniques described hereinbefore to provide an item of clothing that has a continuous, wrap-around pattern disposed on a surface thereof, which would not otherwise be achievable, except by the individual printing of panels of material, followed by hand alignment and sewing.

In summary, the platens, the systems and the processes described hereinbefore enable one to seamlessly print a pattern on a 3-Dimensional substrate using only two printing operations in 2-Dimensions (e.g. "front" and "back" of a substrate). In other words, the technology described herein enables the (potential) complete 3-Dimensional coverage of a substrate using only two printing passes.

The invention claimed is:

1. A platen for printing on an item, the platen comprising:
- a first planar surface;
- a second planar surface, the second planar surface opposite to the first planar surface and separated from the first planar surface in an axial direction;
- at least one peripheral region extending from the first planar surface to the second planar surface; and
- a tapered region comprising a tapered edge formed on at least part of the at least one peripheral region, wherein:
- the platen is suitable for seamless wrap-around printing on an item of clothing;
- the tapered edge is a double-sided tapered edge extending from the first planar surface and the second planar surface respectively and joining along the peripheral region;
- a minimum thickness of the tapered edge formed on the tapered region is from 0.1 to 5 mm;
- the tapered region has a width of from 2 mm to 100 mm; and
- the tapered region has a taper angle from 0.1° to 89.5°.

2. The platen according to claim 1, wherein the platen has one or more of the following features:
- (a) a maximum separation of the first and second planar surfaces is from 0.5 mm to 150 mm; or
- (b) the first and second planar surfaces further comprise an absorbent material.

3. The platen according to claim 1, wherein the at least one peripheral region further comprises a plurality of elongate segments, each segment comprising the tapered region having the tapered edge, the tapered edges being configured to hold an item in a taut arrangement for printing.

4. The platen according to claim 1, wherein the platen has one or more of the following features:
- (a) the at least one peripheral region may further comprise one or more extendible sections for stretching an item;
- (b) the platen is made from one or more materials selected from the group consisting of a metal (e.g. aluminium, stainless steel), a fiber glass and a composite material (e.g. a carbon composite material); or
- (c) the platen is a direct to clothing platen.

5. The platen according to claim 1, wherein the at least one peripheral region further comprises one or more expandable sections for stretching an item, each extendible section comprising the tapered region having the tapered edge, the tapered edges being configured to hold the item in a taut arrangement for printing.

6. The platen according to claim 1, wherein the first and second planar surfaces are in the form of a truss, wherein the at least one peripheral region further comprises a plurality of segments coupled to the truss, each segment comprising the tapered region having the tapered edge, the tapered edges being configured to hold an item in a taut arrangement for printing.

7. A method of printing on an item, comprising:
- placing an item on a platen as described in claim 1;
- printing on a first section of the item corresponding to the first planar surface of the platen; and
- printing on a second section of the item corresponding to the second planar surface of the platen.

8. A printing system comprising:
- a platen as described in claim 3;

a template for alignment of the platen; and a printer.

9. A method of printing on an item, comprising:

placing an item on a platen as described in claim 3;

printing on a first section of the item corresponding to the first planar surface of the platen; and printing on a second section of the item corresponding to the second planar surface of the platen.

* * * * *